US008379886B2

(12) United States Patent
Park

(10) Patent No.: US 8,379,886 B2
(45) Date of Patent: Feb. 19, 2013

(54) OLED AND CONE PAPER MOVEMENT CONTROL DEVICE FOR VISUAL SPEAKER

(76) Inventor: Seung-Min Park, Seoul (KR)

( * ) Notice: Subject to any disclaimer, the term of this patent is extended or adjusted under 35 U.S.C. 154(b) by 232 days.

(21) Appl. No.: 12/735,921

(22) PCT Filed: Feb. 25, 2009

(86) PCT No.: PCT/KR2009/000897

§ 371 (c)(1),
(2), (4) Date: Aug. 24, 2010

(87) PCT Pub. No.: WO2009/107976

PCT Pub. Date: Sep. 3, 2009

(65) Prior Publication Data

US 2011/0002500 A1 Jan. 6, 2011

(30) Foreign Application Priority Data

Feb. 27, 2008 (KR) ..... 10-2008-0017740

(51) Int. Cl.
*H04R 25/00* (2006.01)

(52) U.S. Cl. ..... 381/165; 362/86

(58) Field of Classification Search ..... 362/86; 381/165

See application file for complete search history.

(56) References Cited

U.S. PATENT DOCUMENTS

| | | | | |
|---|---|---|---|---|
| 2,288,607 | A * | 7/1942 | Chandler | 381/165 |
| 5,117,462 | A | 5/1992 | Bie | |
| 7,481,295 | B2 | 1/2009 | Noro et al. | |
| 2002/0057821 | A1 | 5/2002 | Tsumori et al. | |
| 2002/0118847 | A1* | 8/2002 | Kam | 381/111 |
| 2005/0141746 | A1 | 6/2005 | Kobayashi et al. | |
| 2006/0012559 | A1* | 1/2006 | Kang | 345/108 |
| 2008/0212806 | A1* | 9/2008 | Xi | 381/165 |
| 2008/0232088 | A1* | 9/2008 | Hente | 362/86 |
| 2009/0207155 | A1* | 8/2009 | Affolter et al. | 345/204 |
| 2010/0039355 | A1 | 2/2010 | Park | |
| 2010/0195861 | A1* | 8/2010 | King | 381/396 |
| 2011/0026751 | A1* | 2/2011 | Hilbowicki | 381/345 |

FOREIGN PATENT DOCUMENTS

| | | | |
|---|---|---|---|
| JP | 60259097 | A * | 12/1985 |
| JP | 2002-152884 | A | 5/2002 |

(Continued)

OTHER PUBLICATIONS

International Search Report dated Sep. 30, 2009 for corresponding PCT Application No. PCT/KR2009/000897 (and English translation).

*Primary Examiner* — Forrest M Phillips
(74) *Attorney, Agent, or Firm* — Flynn, Thiel, Boutell & Tanis, P.C.

(57) ABSTRACT

The present invention relates to an apparatus for controlling the movement of a cone paper used for outputting sound, and a flexible OLED covered on the cone paper in order to enhance the sound quality of a visual speaker. In a visual speaker which includes a voice coil, a magnet, an edge, a unit enclosure, a flexible OLED for displaying video images, and a speaker cone paper, a visual speaker is characterized in that a speaker cone paper configured to output sound, a flexible OLED covered on the speaker cone paper, an edge, and a unit enclosure are formed in an integral airtight structure filled with a compressed gas, and a compression piston and a compressed gas adjusting device are further disposed for adjusting the pressure of the inner compressed gas, so that it is possible to control the movements of the flexible OLED and the speaker cone paper.

13 Claims, 6 Drawing Sheets

FOREIGN PATENT DOCUMENTS

| | | |
|---|---|---|
| JP | 2007-013730 | 1/2007 |
| JP | 2008-005264 | 1/2008 |
| KR | 1994-2990 | 6/1994 |
| KR | 10-0766520 | 11/2006 |
| KR | 2006-114296 | 11/2006 |

* cited by examiner

OLED AND CONE PAPER MOVEMENT CONTROL DEVICE FOR VISUAL SPEAKER

TECHNICAL FIELD

The present invention relates to an OLED (Organic Light Emitting Device) of a visual speaker and a movement control apparatus of a cone paper, and in particular to a cone paper for emitting sound for enhancing the quality of a visual speaker, and an apparatus for controlling the movement of a flexible OLED covered on a cone paper.

BACKGROUND ART

The proceeding Korean patent number of 10-0766520 (title of invention: Speaker Having Video Screen Function) filed by the same applicant as the present invention discloses a technology in which a conventional speaker cone paper is substituted with a flexible OLED or a flexible OLED is covered on a speaker cone paper, and various video images are displayed on a flexible OLED in sync with audio.

FIG. 1 is a view illustrating the construction of a conventional visual speaker which is formed of a voice coil 24, a magnet 26, an edge 23, an external gasket 20 and a flexible OLED 21. The video images provided from a video/audio PCB chip are displayed on a flexible OLED.

Since the above visual speaker is configured using a flexible OLED instead a conventional cone paper or a flexible OLED is covered on a cone paper, it weighs more than a synthetic resin device or a paper material which are typically used as the material of a cone speaker, so it is not easy to control the quality of sound. In order to overcome the above problems, a voice coil might be wound more depending on the increased weight so as to increase the power, but the whole volume of the speaker increases, and power consumption increases, which leads to an inefficient operation.

The conventional visual speaker is equipped with a plurality of cables at both ends of a speaker cone paper for processing video signals. In order to obtain a substantial resolution, more cables are needed thereby interrupting the movement in edges. When a coated cable is used so as to prevent the oxidation of electric cables, thinner cables are needed along with increased weight.

In case of a conventional speaker, additional characteristics such as a diameter of a speaker, a voice coil, and a corrugation are determined depending on an outer characteristic and a response characteristic. As a speaker cone and a voice coil attached to the speaker cone operate, an electric output is converted into vibration energy. The corrugation is very important in a sound quality design of a speaker because the corrugation damps so as to prevent the speaker from moving so that the speaker cone and the voice coil can be fixed in position. As the time needed for the speaker cone paper to vibrate and return back to a center position is extended, the clarity of sound degrades, so it is needed to increase a damping factor which represents an attenuation characteristic of speaker sound. The method for enhancing a damping factor can be adjusted depending on an amplifier design, a cable loss and a speaker enclosure type, but as a method for adjusting a damping factor in its own unit, no other methods exist except for a corrugation method.

In particular, in case of a voice coil, a thickness is decreased so as to make the speaker smaller, while increasing the output. However, in case of a corrugation device, the size of a corrugation is increased in proportion to the size of a speaker cone paper so as to obtain a desired damping effect of a speaker cone paper, therefore it is impossible to make the corrugation smaller. The corrugation is mainly made of a resin cloth, so it feels hard and flexible. However, their natural characteristics might be degraded depending on the time of use, so tones can change.

DETAILED DESCRIPTIONS OF THE INVENTION

Technical Problems To Be Overcome

Accordingly, it is an object of the present invention to provide an apparatus which is capable of decreasing the volumes of cables which are used for supplying signals to the edges of a flexible OLED while overcoming the problems encountered in the conventional art that the size of a speaker cannot be decreased so as to enhance the sound quality of a visual speaker since it is impossible to make the corrugation smaller in the conventional art.

Technical Solutions

To achieve the above objects, there is provided an apparatus that is equipped with an airtight type unit enclosure, including a flexible OLED and a speaker cone paper, while eliminating a corrugation from a conventional speaker apparatus, with a cable accommodation part and an airtight type unit enclosure being integrally formed in an edge.

Advantageous Effects

In the present invention, it is possible to significantly enhance a sound quality by making a movement more efficient since a damping factor of a speaker cone paper can be significantly increased, so the size of a speaker can be made smaller as compared to the output. In addition, it is possible to prevent a sound quality from being degraded due to the degradation of corrugation since the corrugation is not used in the present invention. Air can be effectively blocked with the helps of an airtight type unit enclosure structure for thereby preventing the oxidation of cable devices, which leads to extending the life span of a speaker system.

BRIEF DESCRIPTIONS OF THE DRAWINGS

The present invention will become better understood with reference to the accompanying drawings which are given only by way of illustration and thus are not limitative of the present invention, wherein.

BEST MODE FOR CARRYING OUT THE INVENTION

Figure 1:
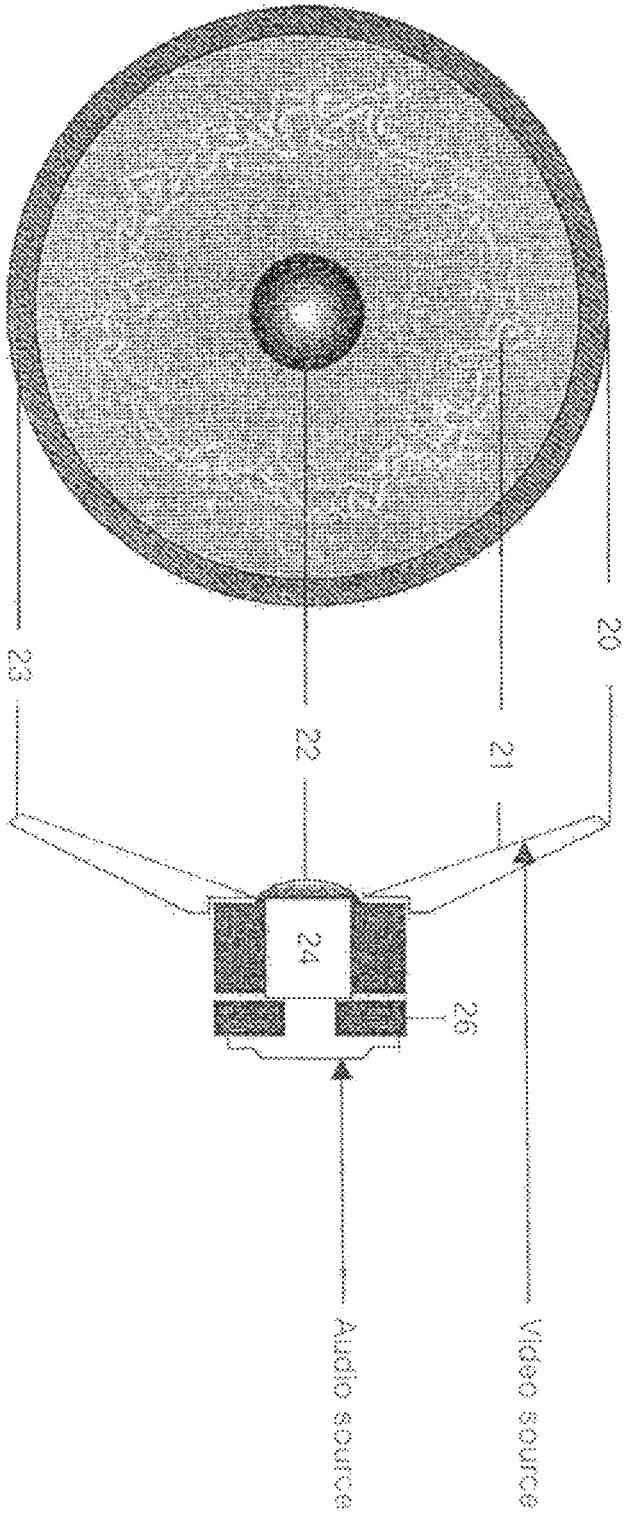
FIG. 1 is a schematic view illustrating the construction of a conventional visual speaker.
Figure 2:
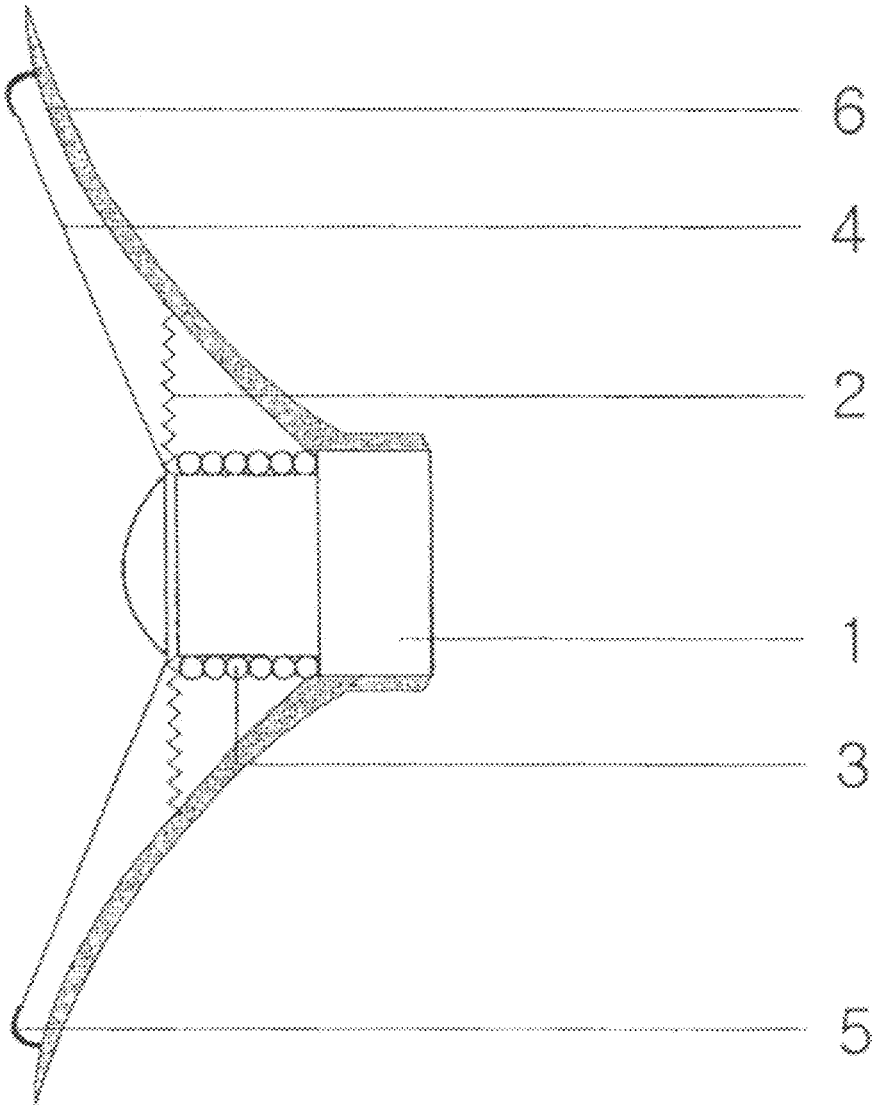
FIG. 2 is a view illustrating the construction of a conventional speaker.

FIG. 2 is a view illustrating the construction of a conventional speaker structure. When a voltage is outputted from an amplifier output terminal to a voice coil 3, a magnetic field is formed in a voice coil. The voice coils moves upward and downward as the magnetic field of the voice coil interacts with a magnetic field formed by means of a magnet 1. Since the voice coil is adhered to a speaker cone paper 4, a speaker cone paper moves along with the movement of a voice coil. The electric output of an amplifier is converted into a vibration energy, by means of which a certain sound is outputted. The speaker cone paper is supported by means of a unit enclosure 6 through an edge 5.

Figure 3:
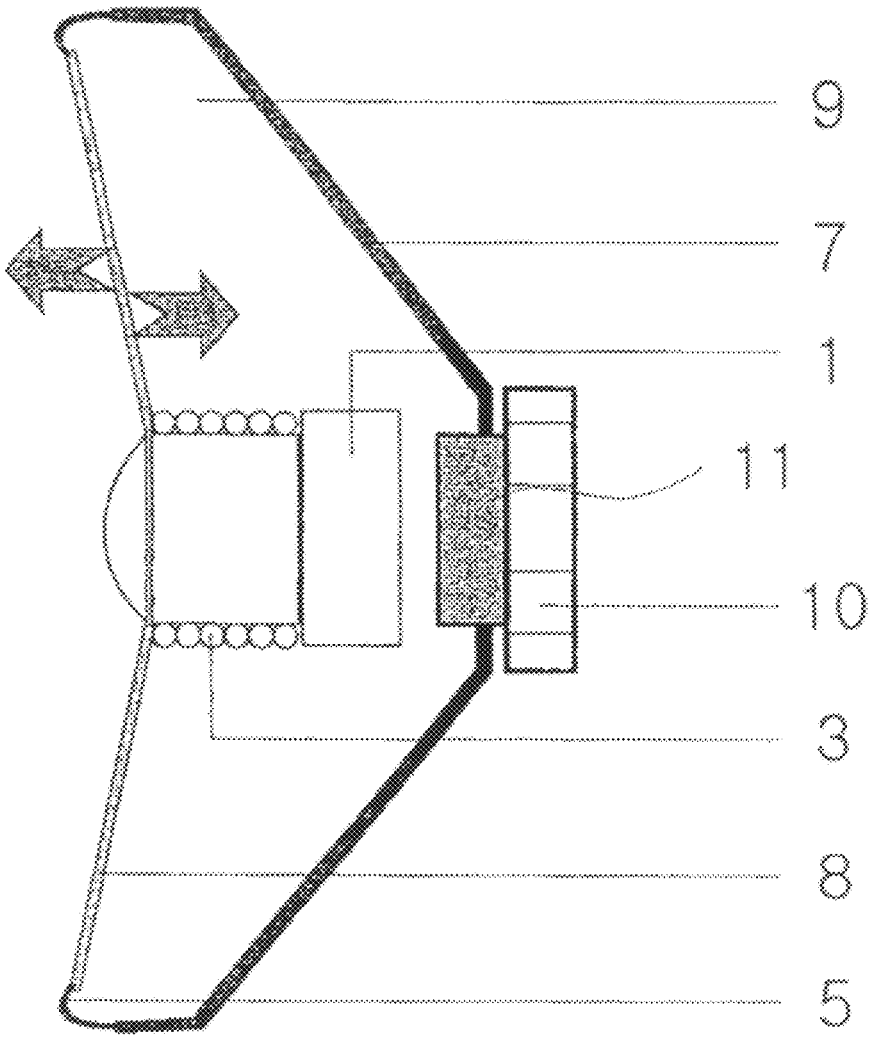
FIG. 3 is a view illustrating the construction of a small size visual speaker having an airtight type unit enclosure according to the present invention.

FIG. 3 is a view illustrating a speaker structure according to the present invention. As shown therein, a corrugation of a conventional speaker is removed, and a flexible OLED and cone paper 8, an edge and a speaker unit enclosure 7 are integrally configured in an airtight structure. A compressed gas 9 is filled in the airtight structure instead of air. In the conventional speaker, a corrugation has a damping function of a speaker cone paper. In the present invention, the above function is implemented by means of a compressed gas filled in the speaker while removing the corrugation. In the conventional speaker, the movement of a speaker cone paper and a voice coil is limited by means of an air pressure of a cone paper in the conventional speaker, but in the present invention the movement of a cone paper increases since the air pressure is not applied in an airtight vacuum structure of the present invention, so it is possible to increase the output level of sound. As a damping obtaining method of a cone paper, a compressed gas is used instead of a corrugation, which conventionally depended on the size of a cone paper, so it is possible to significantly decrease the size and thickness of the speaker as compared to its output, while preventing the tone degradation that might occur due to the degradation of corrugation.

A compressed gas adjusting device 10 is disposed in a back side of the airtight unit enclosure 7 by means of which a user can directly adjust the compression ratio of an inner compression gas so as to obtain a certain damping factor for a music genre. The inner pressure can be increased or decreased by moving a piston 11 forward or backward by rotating a knob of the compressed gas adjusting device 10. The inner compressed gas pressure works in cooperation with a program of a visual speaker, so a motored automatic control using a motor or the like can be automatically achieved based on a genre of music. The compressed gas used can be formed of various mixed gases including helium gas depending on a diameter of a speaker cone.

Figure 4:
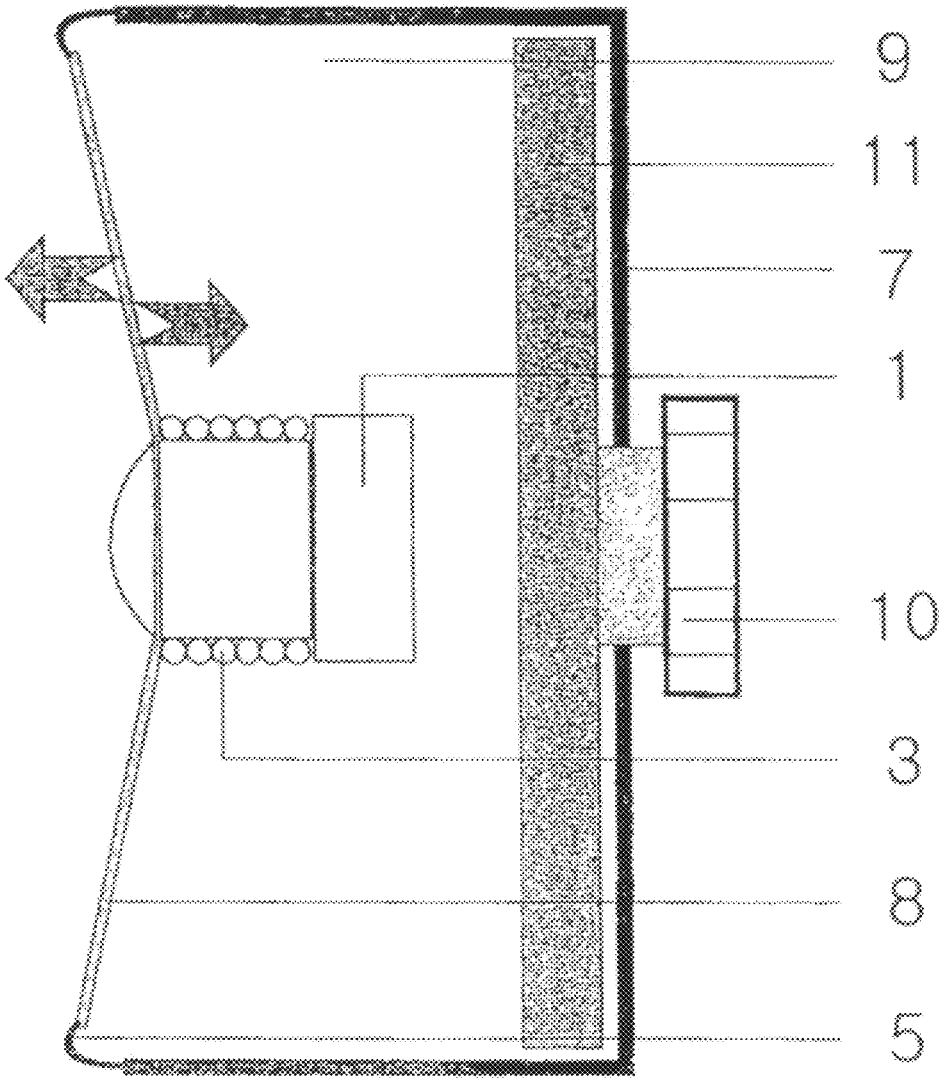
FIG. 4 is a view illustrating the construction of a middle and large size visual speaker having an airtight type unit enclosure according to the present invention.

FIG. 4 is a view of another embodiment of the present invention. The apparatus of FIG. 2 is well applied to a small size speaker, and an airtight cone paper movement control apparatus of FIG. 3 is well applied to a middle and large size speaker. Other elements are same except that a compression piston 11 is formed of a large capacity compression piston which corresponds to a speaker size.

Figure 5:
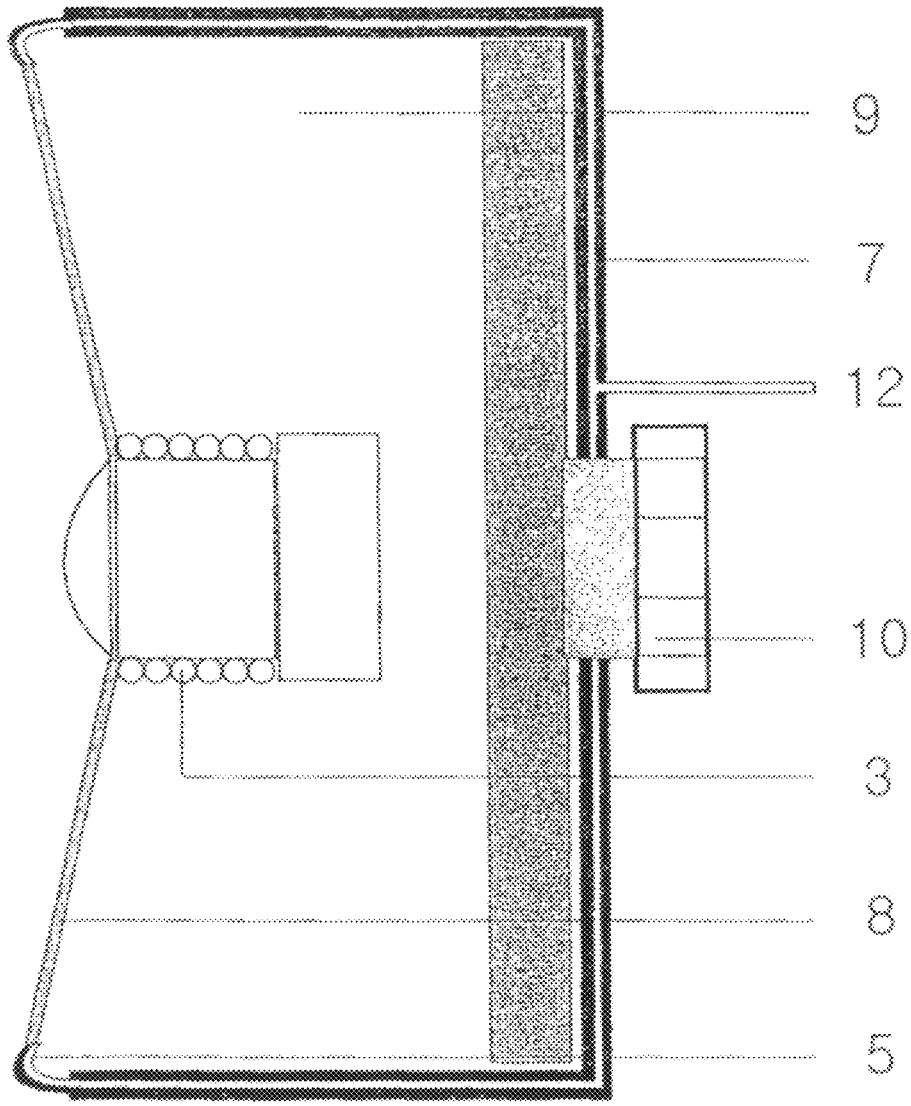
FIG. 5 is a view illustrating the construction of an edge according to the present invention.
Figure 6:
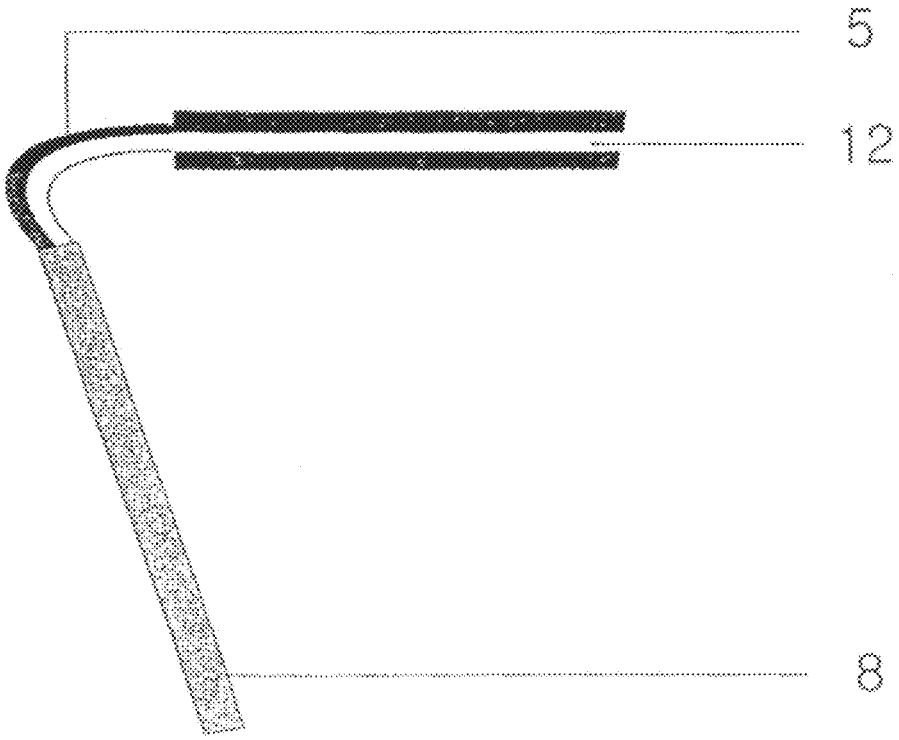
FIG. 6 is a detailed view of an edge of FIG. 5.

As shown in FIG. 5, a cable used for transmitting a signal to a flexible OLED of a visual speaker in the apparatus of FIG. 3 is accommodated in a bus cable shape along an inner side of an edge portion and an airtight unit enclosure. FIG. 6 is a detained view of the edge portion.

INDUSTRIAL APPLICABILITY

In the present invention, since a cable used for transmitting a signal to a flexible OLED is formed in a bus shape in the interior of a unit enclosure along an airtight edge, it does not contact with air, thereby preventing oxidation. In the present invention, a coated cable is not needed, and the size of a cable can be made smaller, and an edge portion does not have any interference in its movement, Because of this, a small speaker size relative to an output can be manufactured.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or the equivalent of such meets and bounds are therefore intended to be embraced by the appended claims.

What is claimed is:

1. In a visual speaker that includes a voice coil, a magnet, an edge, a unit enclosure, a flexible OLED for displaying video images, and a speaker cone paper, a visual speaker characterized in that a speaker cone paper configured to output sound, a flexible OLED covered on the speaker cone paper, an edge, and a unit enclosure are formed in an integral airtight structure filled with a compressed gas, a compression piston and a compressed gas adjusting device are further disposed for adjusting the pressure of the inner compressed gas, so that it is possible to control the movements of the flexible OLED and the speaker cone paper, and a cable used for transmitting a signal to the flexible OLED is accommodated in a bus cable type along an inner side of the edge and the airtight unit enclosure.

2. The speaker of claim 1, wherein said compression piston and said compression gas adjusting apparatus are driven by a motored control device and are automatically controlled so that the inner compression gas pressure can be set depending on the genre of music.

3. The visual speaker of claim 1, wherein said cable is an uncoated cable.

4. The visual speaker of claim 1, wherein the speaker is free from corrugations.

5. A visual speaker comprising:

a speaker unit;

a flexible OLED configured to cover a speaker cone paper, the flexible OLED and the speaker cone paper closing an end of the speaker unit to form an airtight unit enclosure, the speaker unit having an edge whereat the OLED and speaker cone paper are secured to the speaker unit;

a voice coil and a magnet disposed within the speaker unit;

a compression piston; and a compressed gas adjusting device configured to move the piston to adjust pressure of inner compressed gas within the airtight unit enclosure, wherein adjustments in the pressure of the inner compressed gas controls movements of the OLED and the speaker cone paper, wherein the flexible OLED is configured for displaying video images, and the speaker cone paper is configured to output sound.

6. The visual speaker according to claim 5, further comprising a cable accommodated along an inner side and the edge of the speaker unit within the airtight unit enclosure for transmitting a signal to the flexible OLED.

7. The visual speaker according to claim 6, wherein the cable comprises an uncoated cable, and wherein the airtight unit enclosure prevents oxidation therein.

8. The visual speaker according to claim 7, wherein the adjustments in the pressure of the inner compressed gas for moving the OLED and the speaker cone paper to change a damping factor of the speaker cone paper.

9. The visual speaker of claim 8, wherein said compression piston and said compression gas adjusting apparatus are configured to be driven by a motored control device and are configured to be automatically controlled so that the pressure of the inner compressed gas is set depending on the genre of music.

10. The visual speaker according to claim 9, wherein the visual speaker is free from corrugations.

11. The visual speaker according to claim 5, wherein the adjustments in the pressure of the inner compressed gas move the speaker cone paper and change a damping factor of the speaker cone paper.

12. The visual speaker of claim 5, wherein said compression piston and said compression gas adjusting apparatus are configured to be driven by a motored control device and are configured to be automatically controlled so that the pressure of the inner compressed gas is set depending on the genre of music.

13. The visual speaker according to claim 5, wherein the visual speaker is free from corrugations.

* * * * *